United States Patent [19]

Taylor

[11] 4,284,137

[45] Aug. 18, 1981

[54] ANTI-KICK, ANTI-FALL RUNNING TOOL AND INSTRUMENT HANGER AND TUBING PACKOFF TOOL

[76] Inventor: William T. Taylor, P.O. Box 309, Warren, Tex. 77664

[21] Appl. No.: 109,896

[22] Filed: Jan. 7, 1980

[51] Int. Cl.[3] ..... E21B 33/128; E21B 33/129

[52] U.S. Cl. ..... 166/137; 166/123; 166/131; 166/134; 166/182

[58] Field of Search ..... 166/240, 123, 181, 182, 166/131, 134, 138, 140, 137; 175/321, 322, 325

[56] References Cited

U.S. PATENT DOCUMENTS

| | | | |
|---|---|---|---|
| 1,739,928 | 12/1929 | Thompson | 175/322 X |
| 2,850,097 | 9/1958 | Bloom | 166/264 X |
| 3,026,941 | 3/1962 | Muse | 166/240 X |
| 3,054,454 | 9/1962 | Evans | 166/240 X |
| 3,233,453 | 2/1966 | Lebourg | 166/264 X |
| 3,235,017 | 2/1966 | Lynes | 175/321 |
| 3,282,343 | 11/1966 | Tausch | 166/240 X |
| 3,398,795 | 8/1968 | Elliston | 166/138 X |
| 3,412,790 | 11/1968 | Brown | 166/240 X |
| 3,412,802 | 11/1968 | Kisling | 166/138 X |
| 3,746,090 | 7/1973 | Read et al. | 166/240 X |

*Primary Examiner*—Stephen J. Novosad

*Attorney, Agent, or Firm*—Guy E. Matthews

[57] ABSTRACT

An instrument hanger for use in tubing is disclosed with an anti-kick, anti-fall running tool. In one embodiment, the tool includes an internal mandrel, an external sleeve, with the mandrel being tapered wherein the external sleeve supports upwardly pointed detents and downwardly pointed detents against the taper which detents prevent untimely fall of the tool and untimley upward movement thereof.

The tool combination includes a packer element including a set of expandable slips or collet fingers functioning in conjunction with the packer to expand and plug the tubing string. Further tool combination may support an instrument package such as a downhole pressure measuring mechanism used to obtain downhole pressure readings after isolating above a particular zone.

The tool combination further includes a valved flow path across the packer element which is selectively released at the time of release of the tool combination which vents any bottom hole pressure differential and enables retrieval of the tool combination. During retrieval, the instrument package cannot be dropped because the anti-fall detents are set against prefall.

15 Claims, 12 Drawing Figures

FIG. 3A
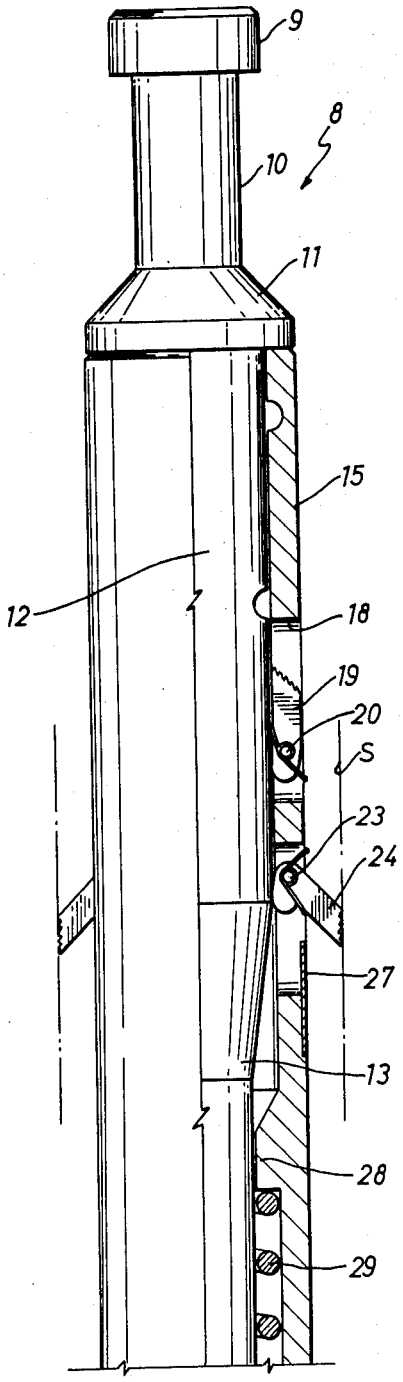
FIG. 3B
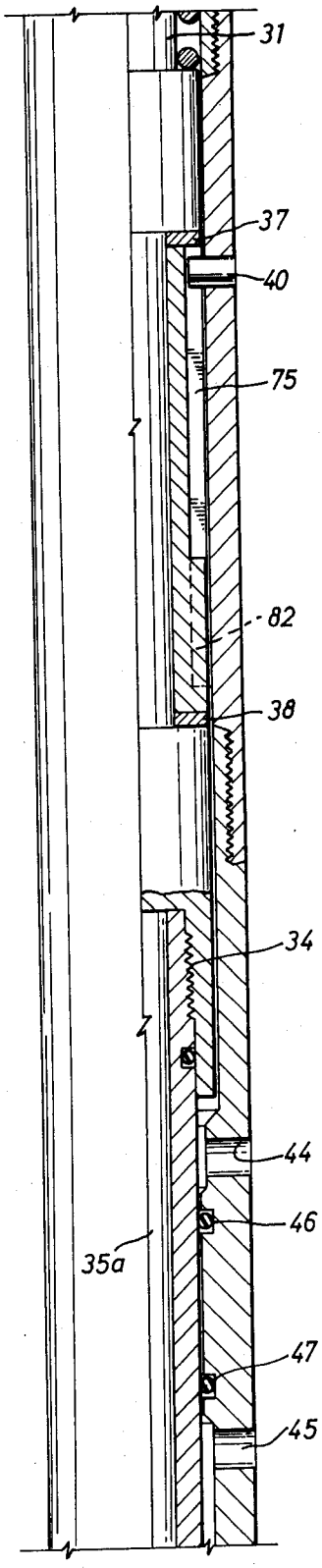
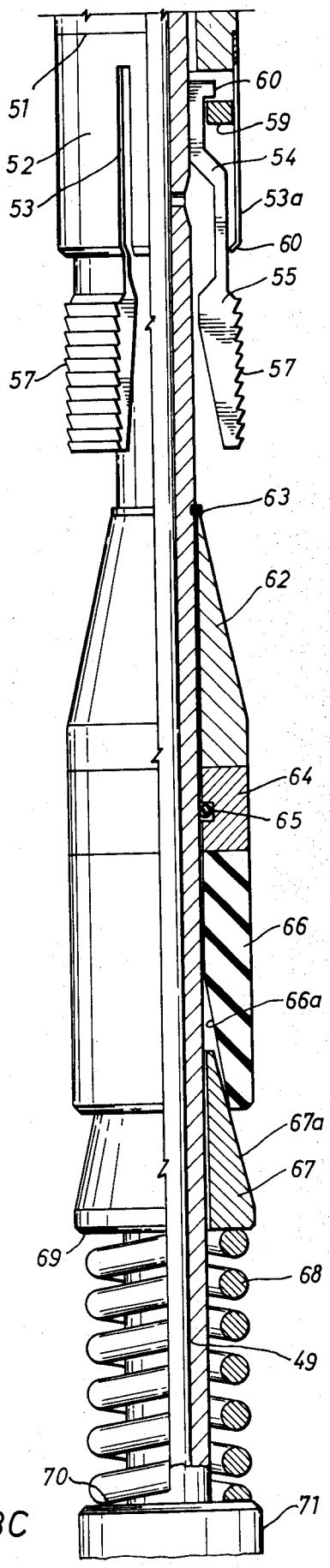
FIG. 3C

ANTI-KICK, ANTI-FALL RUNNING TOOL AND INSTRUMENT HANGER AND TUBING PACKOFF TOOL

BACKGROUND OF THE INVENTION

In producing oil and gas wells, a tubing string is normally installed in the well extending from the surface into the hole, whether cased or open, downwardly to the production zone of interest. As is known, there may be two or three zones flowing into a well and there may be more than one tubing string in the well, with each tubing string isolated from other tubing strings and typically extending to different production zones. Optimum production of oil and gas from a given well is often dependent on the flow rate of the well which in turn is substantially dependent on the zone or formation pressure. Normally the pressure drops the instant that any flow occurs and to this extent, a measurement of pressure at the well head is not normally reflective of a formation pressure. Formation pressure is best measured at the formation itself; further it is sometimes also helpful to measure other variables at the formation such as temperature.

Typically, formation measurements must be taken over a time period, often ranging as high as twenty-four hours. The typical instrument used for measurement of bottom hole pressure or other bottom hole variables is a clock driven chart mechanism. Of necessity, it is rugged and yet comprises a delicate instrument package. To prevent damage, the mechanism is run into the tubing string and subsequently retrieved with a minimum of banging, jarring, and/or dropping. Moreover, the mechanism is best installed on a device which may be left untended over the requisite time span to avoid excessive personnel charges.

With the foregoing being only exemplary the present invention discloses a tool capable of packing off the tubing string when it is installed. To this end it incorporates an expandable resilient element which includes a slip or collet operated expandable mechanism which locks in place and enables bleeding off of pressure at the time of release of the packoff. Further, since the tubing string is plugged by the tool, there is the likelihood of pressure build up below the tool and hence, there is a means for releasing pressure below the tool.

In addition a plurality of setting or detent means are provided in combination with the isolation means to prevent unwanted dropping or upward movement by the isolation means.

SUMMARY OF THE INVENTION

The apparatus of the present disclosure is an instrument support tool which incorporates an expandable slip to anchor the tool in a tubing string and also includes an expandable resilient packer element to close off the tubing string by incorporating an external sleeve and an internal mandrel. The mandrel is tapered, and positioned adjacent to upwardly and downwardly facing setting means or detents which are spring loaded and which serve as means resisting untimely fall or upward movement of the tool combination. The tool is provided with a pin on the external sleeve and a set of shaped gooves on the internal mandrel which control axial movement of the mandrel and sleeve. This movement causes the setting of the slips and the positioning of a transverse passage through the mandrel and sleeve which controllably vents pressure at the time the tool is released, bypassing the packer element to reduce or equalize pressure across the tool prior to release.

DESCRIPTION OF THE DRAWINGS

FIGS. 3A, 3B, and 3C are similar to the previous figures and disclose the tool combination in a released position during pulling from the tubing string;

DESCRIPTION OF THE PREFERRED EMBODIMENT

Figure 1A:
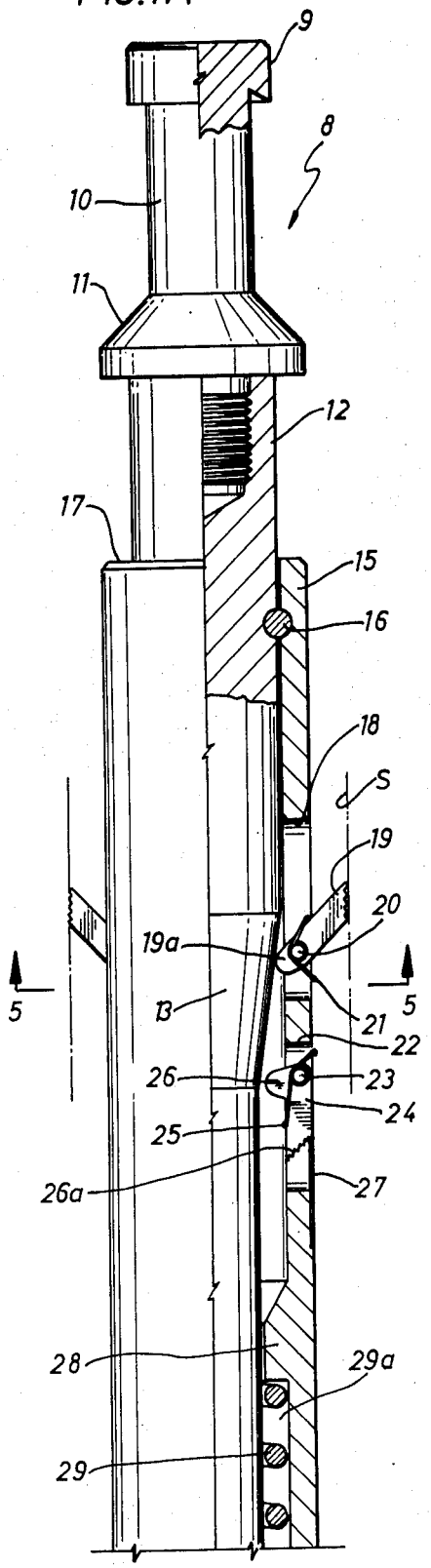
FIGS. 1A, 1B, and 1C jointly disclose the tool combination of the present disclosure in sectional view for running into a downhole tubing string.

The tool of the present invention is identified by the numeral 8 in FIG. 1A. The tool 8 will be described proceeding from top to bottom and referring primarily to FIGS. 1A, 1B, and 1C. Thereafter, the operating positions of the tool will be related to the other drawings. At the top end, the numeral 9 identifies an enlarged shoulder on a narrow neck 10 which serves as a fishing neck to enable the tool to be removed from the well bore (not shown). The narrow neck 10 terminates at a tapered enlargement 11 which is threaded to a central mandrel 12 extending downwardly. The mandrel 12 is tapered inwardly at 13 at a preferable angle in the range of 10° to 20° and the mandrel 12 slidably telescopes within an outer tubular member 15. However, the mandrel 12 and member 15 are releasably joined by means of a shear pin 16 by drilling a hole through the mandrel 12 and the sleeve 15 to accept the shear pin. As will be observed, pin 16 is partly held by the mandrel 12, and thus defines a means which controllably releases the tool for operation by shearing the sub or pin by jarring on the tool combination 8.

Upon shearing, the sleeve 15 has an upper shoulder 17 which is selectively moved upwardly against the enlargement 11; however, when pinned, shoulder 15 is substantially positioned below the enlargement 11 (FIG. 1A).

The sleeve 15 has a set of longitudinal slots 18 formed therein and each slot 18 receives a finger 19 which is positioned in the slot by mounting fingers 19 mounted on a transverse pivotal shaft 20 in the slot. Each of the plurality of shafts 20 holds the fingers for pivotal movement toward the tubing string 5 fingers 19 serve as a detent or setting means against undesired movement of tool 8 and is biased and spring loaded by a spring means 21 which forces the detent 19 outwardly against string 5.

The detent or setting means 19 has an alternate position where it is received fully within the slot 18 by movement 9 the mandrel 12 downwardly, and when the tapered surface 13 of the mandrel moves downwardly against the segment 19*a* to rotate the detent 19 counterclockwise into the slot 18. Normally springs 20 force each detent 19 outwardly; it will also be observed that the outer tip of each detent 19 is serrated to provide teeth on it for gripping the wall of string 5 and the opposite end 19*a* of each of the detents 19 is smoothed or rounded to enable it to ride on the tapered surface 13 of the mandrel 12 as the mandrel 12 moves relative to the detent 19. As illustrated, the spring 21 is thus wound around the shaft 20 and the two ends of the spring 21 are bent under, one end bent under one of each of the detents 19 and the opposite end folded over the edge of one of each of the slots 18 which anchors one of each of the springs 21. It is to be understood that this arrangement is duplicated at multiple locations depending on the number of setting moves desired.

Yet another plurality of slots 22 are formed in sleeve 15 below slot 18 for receiving a plurality of L-shaped detents 24 each of which is supported on a pivot shaft 23 and spring loaded to enable rotation of the lower end of each of the detent 24 outwardly by springs 25. Each of the detents 24 includes a protruding upper end 26 which serves as a cam positioned adjacent the tapered surface 13 on the mandrel. It should be observed that each of the detents 24 are pivoted at the upper end rather than the lower end in comparison with the detent 19 for enabling the lower end of each of the detents 24 to deflect or rotate counterclockwise outwardly at the urging of mandrel 13 as it moves downwardly to overcome the bias of spring 25. Again, the spring 25 has two ends which are folded under, one end being bent and folded over the edge of the slot 22 which anchors it and the opposite end being folded under against the detent to force it by counterclockwise rotation as viewed in FIG. 1A.

The lower end of each of the detent 24 is provided with serrated teeth 26*a*. Each detent is spring loaded to deflect its end outwardly as depicted in FIG. 1A and is held at the retracted position by a leaf spring 27 which is attached to the tubular member 15 and which extends into the slot 22 for engaging the teeth 26 and to hold the detent 24 in position. The leaf spring 27 force is cantilevered and being relatively thin, is overcome by rotational movement of the end 26*a* of the detent 24 outwardly when the tapered surface 13 moves relatively downwardly and deflects the protruding cam portion 26 to cause the end 26*a* of the detent to move radially outwardly. When the end 26*a* moves the cantilevered leaf spring 27 is pushed aside, and the teeth 26*a* slide over the tip of the spring 27. Once the end 26*a* is pushed and rotated to the extended position, the end 26*a* maintains that position having overridden and escaped contact with the leaf spring 27 being held in that position by the spring 25 which is coiled around the shaft 23 (FIG. 3A).

Thus it is observed that the first set of detents 19 prevent upward movement of the tool when the tool combination 8 is being run into the tubing strings. The anti-kick, anti-fall tool is positioned in the tubing strings with the shear pin 16 intact and the detents 19 are thus extended after shearing pin 16 and only as a result of the movement by the tapered surface 13 which enables the tool 8 to be run into tubing strings on a wireline without fear of pressure surges. If a pressure surge occurs, the detents 19 hold against upward movement.

The detents 24, when timely extended, enable the tool 8 to be retrieved on a wireline without fear of dropping because should the tool 8 be dropped the mandrel 12 moves downwardly to enable tapered surface 13 to contact the detents 24 as set forth hereinabove to extend detents 24. The detents 24 extend to prevent falling of the tool and any instrument or tool package which is carried by it. The sets of detents function at different points in time as will be described hereinbelow.

The tubular sleeve 15 includes an internally directed shoulder 28 which abuts a coil spring 29 mounted around mandrel 12 between the annular space 29*a* formed between mandrel 12 and the tubular sleeve 15. The coil spring 29 bears against a threaded coupling 30 shown in FIG. 1B to force the sleeve 15 upwardly.

Figure 1B:
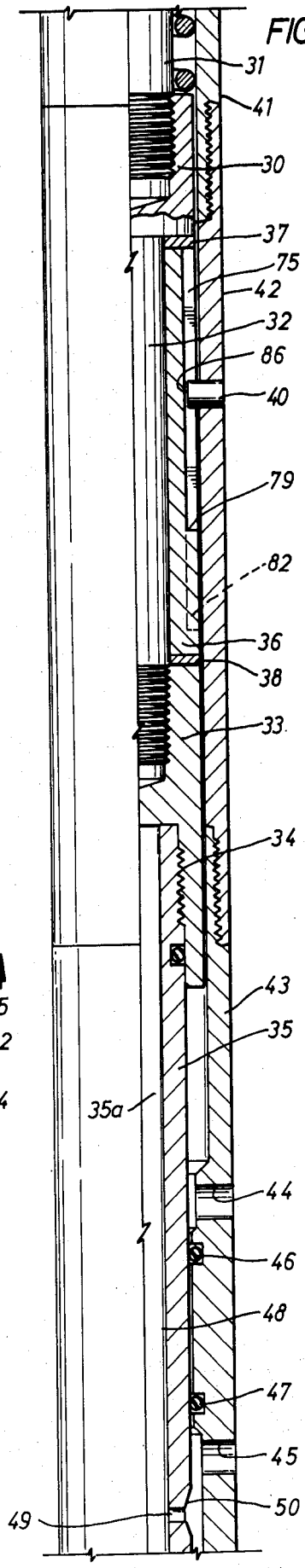

The mandrel 12 when used with a combination tool is made of multiple components and includes the first solid mandrel portion 31 which extends from the coupling 30 upwardly (FIG. 1A) and coupling 30 is integrally threadedly engaged with a central mandrel 32 which is threadedly engaged at coupling 33 (FIG. 1B). Coupling 33 is countersunk and tapped, enabling it to thread to the mandrel 32. Coupling 33 also includes threads 34 which are formed at the lower end thereof in a countersunk opening (not numbered) for threaded engagement to lower mandrel portion 35. The mandrel 35 is hollow or has an opening 35*a* there, though for purposes to be described hereinafter and is threadedly engaged with the coupling 33.

The central mandrel 32 supports a grooved sleeve 36 on the outer periphery thereof. The grooves formed in the sleeve 36 are better shown in FIG. 6 and will be described more fully hereinafter. The sleeve 36 is rotatable about the mandrel 32 and is supported at both ends by means of thrust bearings 37 and 38. As illustrated (FIG. 1B) thrust bearings 37 and 38 abut the couplings 30 and 33 respectively.

The sleeve 36 is positioned adjacent to pins 40, (only one shown in FIG. 1B) which are anchored in the outer sleeve 15 to extend inwardly and are located 180° from one another.

The sleeve 36, the grooves fromed therein and the pins 40 control the radial axial shifting of the sleeve 15 around the mandrel 12 once the shear pin 16 has been sheared.

For ease of assembly, the outer tubular member 15 is also formed in multiple parts and incorporates an upper sleeve portion 41 shown in FIG. 1B which threadedly engaged to a central sleeve portion 42 which is threadedly engaged to lower sleeve portion 43. For ease of assembly and machining, separate portions of sleeve 15 are used although the sleeve 15 could be formed integrally.

Sleeve 15 incorporates a laterally directed passage 44 (FIG. 1B) which opens from the annular area (not numbered) between sleeve 43 and string 5 to the interior of the tool. A similar passage 45 is formed at a lower point on the sleeve 15. The passages or ports 44 and 45 are separated by a pair of seal members or O-ring seals 46 and 47 which fully surround the mandrel 12 and fit in appropriate O-ring slots as illustrated formed in the interior wall of sleeve 43.

The hollow mandrel 35 incorporates the axial passage 35*a* which extends through the lower mandrel 35 to the coupling 33 where it is sealed at the coupling against leakage. A small lateral passage or port 49 is formed in the wall of the mandrel 35 and may be selectively open to the passages 44, 45 or may be isolated from both by the seal rings 46 and 47 as desired. The exterior of the mandrel 35 is indented at 50 around the opening of the port 49 to enable the seals 46 and 47 to smoothly slide over the opening of the passage 49. When the port 49 is positioned between the seals 46 and 47, due to movement of mandrel 35, passage 49 is isolated so that there is no fluid, pressure, gas, oil, or other flow to the exterior of the tool.

Figure 1C:
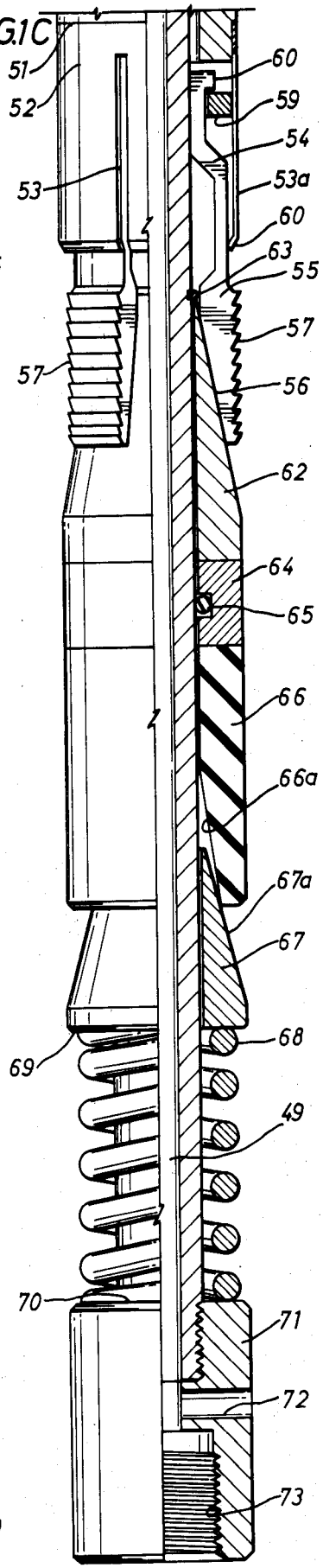

As illustrated in FIG. 1C, the sleeve 43 terminates at shoulder 51, and a collar 52 is positioned about the periphery of the shoulder. The collar 52 is provided with a plurality of slots 53 which extend along the longitudinal length thereof. Each slot 53 defines a plurality of collet fingers 53*a* which is positioned over each of a plurality of separate fingers 54. The fingers 53*c* defined by the slots 53 are rather flexible whereas fingers 54 are relatively not so because they are made of heavier stock. For each finger 53*a* in the collar 52, there is a separate finger 54 positioned therebeneath. Each of the fingers 54 extends downwardly to an enlargement 55 having a tapered inner face 56 and upwardly facing serrated teeth 57 on the exterior for gripping the interior wall of the tubing strings. Each of the fingers 54 positions flat against the mandrel at its upper end and the collar 52 includes an internally appended segmented tab 59 which locks against an overhanging shoulder 60 on the upper end of each of the fingers 54 which keeps the fingers 54 from falling from under the collet fingers 53*a*.

The collet fingers 53*a* tension or flex inwardly and outwardly and are tipped or folded inwardly at their outer tips at 60 to bear against the fingers 54 to contact and hold fingers 54 (FIG. 1C). Each of the fingers 54 incorporates the sloping surface 56 which fits against or abuts a tapered cone 62 positioned around the mandrel 12. Tapered cone 62 is held in position by a ring 63 which is joined to the outer wall of the mandrel 35 and is thus prevented from sliding upwardly. The serrated teeth 57 of fingers 54 are shown in the retracted position and as mandrel 35 moves downwardly the outwardly tapered cone 62 force the tapered portion 56 of each finger 54 outwardly in FIG. 1C causing the finger 54 to pivot about its upper end and tab 59.

The tapered cone 62 has a tapered surface extending at an angle up to about 15° and connects with a thimble 64 which is provided with an internal O-ring seal 65 which surrounds the mandrel 35. The thimble 64 is appended to a resilient skirt 66 made of a resilient material to enable it to flair outwardly to enable the skirt to serve as a seal cup for closing the tubing strings skirt 66 is positioned concentrically about the mandrel 55 and is attached to the thimble 64 and the tapered cone 62. The skirt 66 is flaired outwardly by driving a hollow tapered cone 67 upwardly into the skirt 66 such that the outer taper 67*a* matches the inner taper 66*a* of skirt 66. The tapered cone 67 is telescoped around the mandrel and is able to slide thereon and is forced upwardly by a coil spring 68 which bears against the lower shoulder 69 as skirt 66. The coil spring is positioned around sleeve 35 and is compressed against a shoulder 70 of coupling 71 which is threadedly engaged to sleeve 35. The coupling 71 has a lateral passage or port 72 which introduces the bottom hole pressure to the lower end of the mandrel 12 or sleeves 34 for enabling flow through the passage 49.

The coupling 71 is threaded at 73 to threadedly receive the upper threaded end of an instrument package to be suspended by the combination tool 8.

Figure 6:
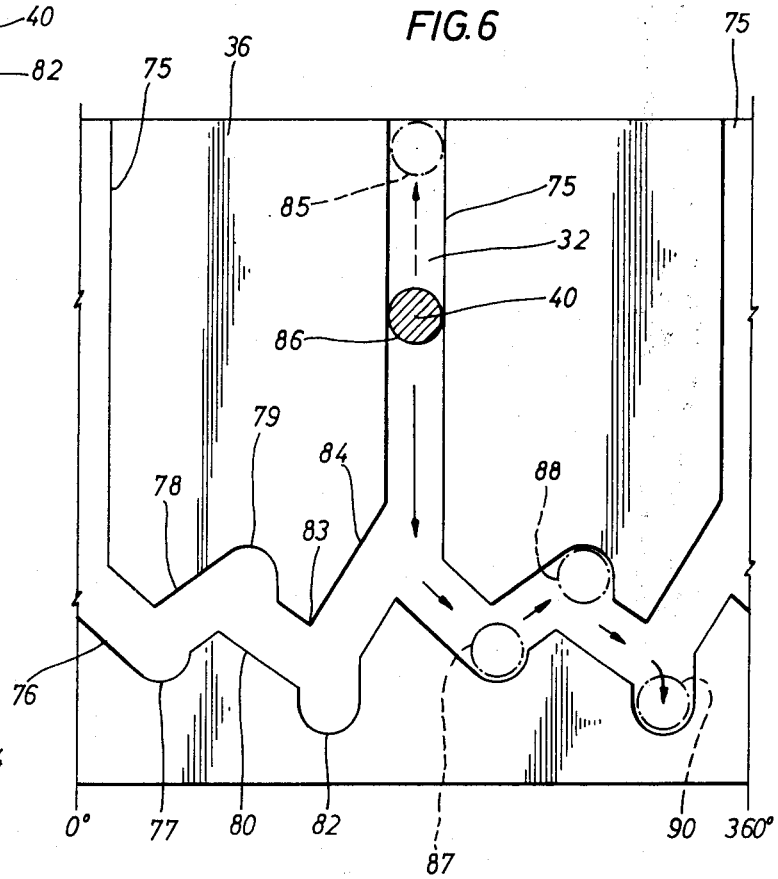
FIG. 6 is an unfolded view of a groove formed in and extending around the tubular member.

Attention is next directed to FIG. 6 of the drawings wherein the pin 40 extends into the several path grooves formed in the sleeve 36. The sleeve 36 is illustrated with its entire external surface drawn in a single X-Y plane. It will be observed that the upper end of the tubular sleeve 36 incorporates a longitudinal passage 75 which extends to adjacent thrust bearing 37 thus enabling the pin 40 to be assembled with the sleeve. In addition, the passage 75 is duplicated at the opposite side of the sleeve for receipt of the other pin 4 and sleeve 36 has a groove path pattern which is duplicated and accordingly, it is necessary to explain only one-half of the groove path shown in FIG. 6 since each pin 40 travels only over one-half of the groove path for radial axial movement of the sleeve 36.

The groove 75 receives pin 40 to enable complete longitudinal movement of the sleeve 36 with the mandrel 42 limited solely by the upper travel of the pin 40 to the top end of the groove 75 adjacent bearing 37 movement in this direction is also limited by the shoulder 17 which encounters the enlargement 11 shown in FIG. 1A on upward movement of the sleeve 36 relative to the mandrel 12. Path groove 75 extends longitudinally downwardly and pin 40 positioned in the groove 75 encounters an angled shoulder path 76 deflects pin 40 to a dead end position or rest stop 77. The curved shoulder path 77 is formed to catch the pin 40 and to limit its further downward travel relative to the sleeve 36. The spring 29 is coiled and imparts movement to sleeve 36 causing the pin 40 to rebound from the curved shoulder path 77 upwardly against the opposite shoulder path 78 which permits expansion of the spring 29 directing the pin 40 along the path leading to a curved shoulder path 79. The shoulder path or stop holds the pin indefinitely. At the next operation of the combination tool 8, the pin 40 is moved relatively downwardly (FIG. 1B) against the shoulder path 80 to move the pin 40 away from the curved corner shoulder path 79 towards a corner shoulder groove path 82. The curved shoulder path 82 serves as a rest or stop and guides the pin 40 past corner 83 on the opposite shoulder of the path groove. In this position, the pin 40 can be guided by the shoulder path 84 on relaxation of the coil spring 23 and the shoulder path 84 enables the pin to move upwardly into slot 75.

The numeral 85 identifies the top most location of the pin in the slot 75. This location is associated with movement of the sleeve 15 to the upper most position permitted against the enlargement 11 and is achieved with pulling of the tool (FIG. 3) as is illustrated in FIG. 3A. The numeral 86 identifies the position achieved by the pin 40 in path 75 associated with running the tool into the drill string and is the pinned position of the sleeve 15 relative to the mandrel 12 (FIG. 1A). The numeral 87 (FIG. 6) identifies a position achieved by the pin 40 in the grooved circular path in sleeve 36 and illustrates pin 40 at the lower range of movement. This is the position achieved when setting the apparatus 8 in the tubing string. When set, it holds formation pressure by means of expansion of the packer elements as will be described hereinbelow. The normal or set position of the pin is illustrated at 88.

After the combination tool 8 has been set as at 88 and the desired tests completed, it is necessary to vent bottom hole pressure for removal of the tool. The circular grooved path enables movement to a venting position which is achieved by shifting the pin 40 along the groove path to the position 90 held by lifting up on the tool by engaging the top fishing neck with an overshot on a wireline to engage lower shoulder path 82. In operation (FIG. 1) with the tool in the running position, the tool is inserted into a tubing string before a desired test is performed. The tool 8 is lowered on a wireline into the tubing string by means of an overshot on neck 9 to an appropriate elevation. At that elevation, it is set in a manner to be hereinafter described. As the tool is run into the hole, the tapered surface 13 on the mandrel 12 forces the spring loaded detents 19 to deflect outwardly to engage the tubing strings. In the event that a blowout or surge in the tubing string occurs, the detents 19 will catch and hold the inner surface of string 5 to prevent the tool from rocketing or moving up the tubing string forced by a pressure surge.

As the tool is run down the tubing string 5 any fluid or pressure build up below the tool is overcome utilizing the port 72, central passage 35*a* in the mandrel 35 which is then bled through the ports 49 and 45 (FIG. 1B) in to the annulas above cup 66. It will be observed that the slips or collets 54 are retracted, and the resilient cup 66 is not expanded, and hence, both the slips 54 and the packer element 66 are not in contact with the tubing strings.

As set forth hereinabove the tool 8 is released for use by a sufficient jar to shear pin 16 wherein an upward pull on the tool 8 pulls the internal mandrel 12 upwardly and the detents 19 hold against upward movement which anchors the sleeve 15 against shoulder 11 causing the spring 68 to be compressed which moves wedge member 68 upwardly forcing packer element 66 outwardly to isolate the string 5. In addition, the fingers 54 (FIG. 2C) are moved radially outwardly to also engage the teeth 57 with the tubing string 5 to thereby set the combination tool 8 relative to the string 5. The expandable collet finger 54 grips and holds the sleeve 36 via outwardly deflected fingers 53*a*. The upward pull on the mandrel 12 also shifts the pin 40 through the position 87 to the position 88 where it is set for enabling tests to be run. The pin thus holds the sleeve 36 in position and prevents radial rotation about the grooved circular path to prevent retraction of the collet fingers 54 (FIG. 2C).

After the test has been completed, an overshot tool is used to re-engage the fish neck 9 of the mandrel 12 to pull upwardly which causes the pin 40 to move from groove path 79 to shoulder rest 82 or position 90 (FIG. 6) which rotates sleeve 36 about mandrel 32 and thereby enables the bottom hole pressure to vent and the pin 40 to move to the slot portion 75 and position 85 which rotates the sleeve 36 to the position illustrated in FIG. 3B. On release of the finger 54 and port element 66 from the string 5 the spring 29 which is under compression when the tool 8 is out, expands thereby forcing the sleeve 15 to the upper limits of its travel (FIG. 3A). It should be noted that the detents 19 are retracted into slot 18 because tapered surface 13 has moved downwardly to cause the detents to rotate inwardly and additionally the tapered surface 13 moves into contact with the rotatable cam 26 on the lower detents 24 forces them outwardly to overcome the leaf spring 27 enabling the detents 24 to pivot to the extended position against the string 5 thus preventing dropping of the tool. Since upward movement of the sleeve 15 retracts the collet fingers 54, and retracts the packer element 66 the tool may be retrieved. The tool is further protected against dropping by the detents 24 as set forth hereinabove.

Figure 2A:
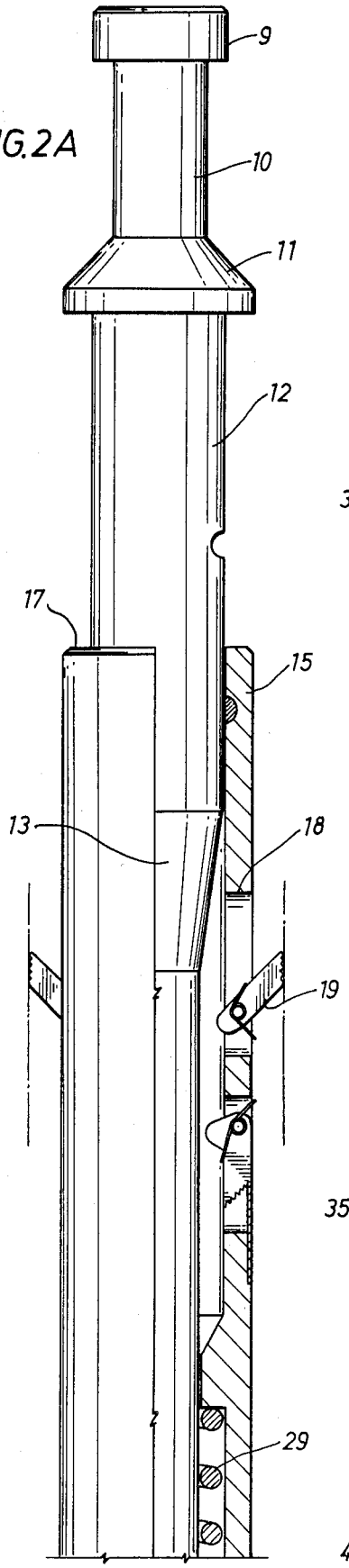
FIGS. 2A, 2B, and 2C are similar to FIGS. 1A, 1B, and 1C respectively and they jointly show the tool combination set in the tubing string and closing off the zone to be isolated.
Figure 2B:
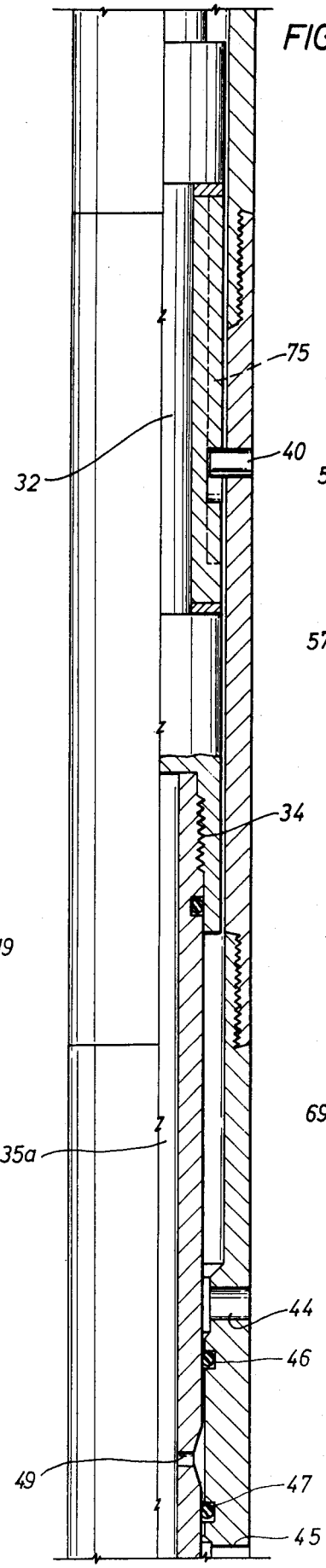
Figure 2C:
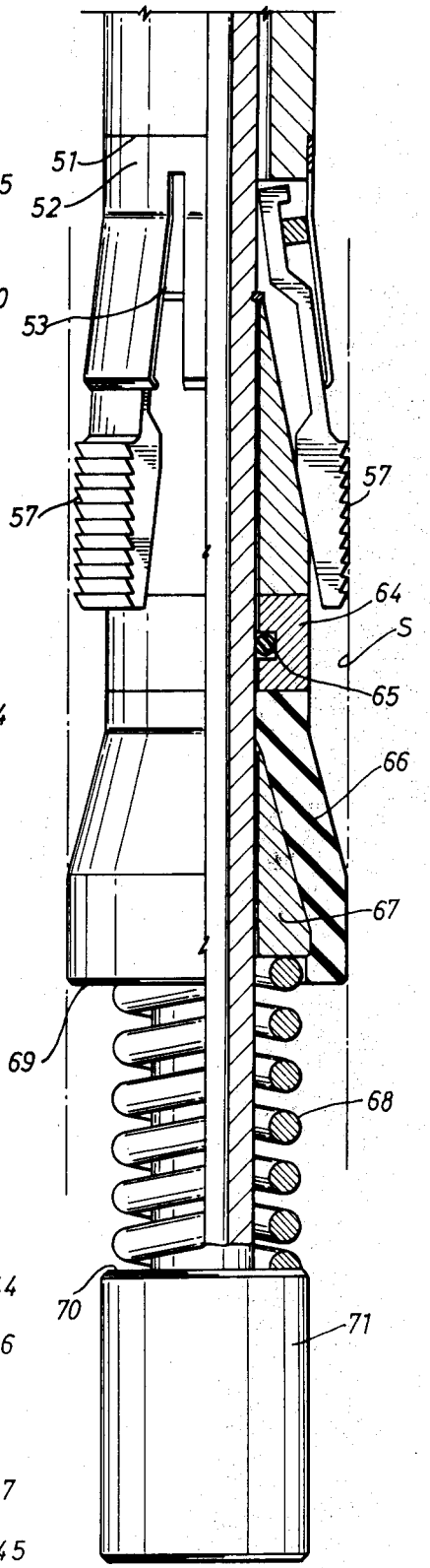

As illustrated in FIG. 2B when the tool 8 is set, mandrel 35 has moved upwardly to position the port 49 between the seals 46 and 47 which prevents downhole pressure from venting above packer element 66 thus isolating the production zone below the element 66.

Figure 4:
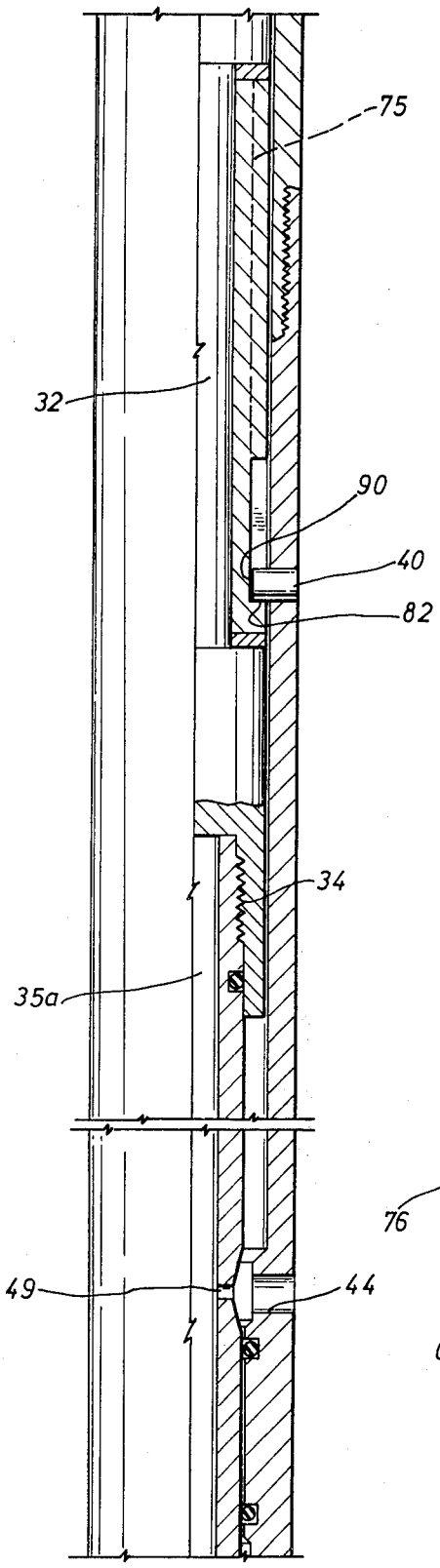
FIG. 4 is an enlarged detail view of the central portions of a segment of the tool combination showing the transverse passage through the internal mandrel and the outer tubular member bypassing pressure below the tool to equalize pressure across the tool.
Figure 5:
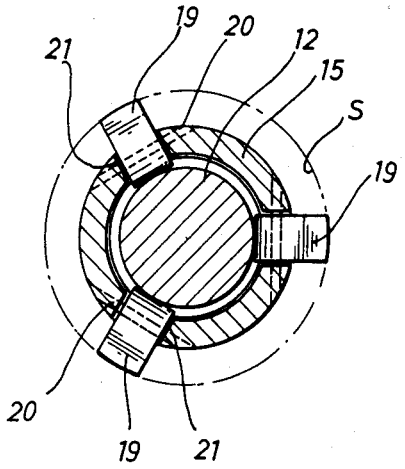
FIG. 5 is a sectional view along the line 5—5 of FIG. 1A showing details of the setting means of the anti-kick, anti-fall running tool segment of the tool combination which contact the tubing string.

This position of sleeve 36 and port 49 should be contrasted with the position of the port 49 in FIG. 4 wherein the pin is at position 90 at shoulder stop 82 and the port 49 is aligned with the lateral port 44. It will be recalled that the position of FIG. 4 is obtained by pulling up on the fishing neck 9 of mandrel 12 to compress spring 29. When the upward pull is released slightly, the spring 29 forces the mandrel 12 downwardly and reverses the position of the detents 19 at the upper end of the tool which frees the tool 8 from its engagement with the tubing string.

The foregoing disclosure is directed to the preferred embodiment of the present combination tool and the scope of the present disclosure is determined by the claims appended hereto.

I claim:

1. An apparatus for use in a tubing string to isolate a portion thereof and which apparatus supports an instrument package therebelow which comprises:
   - an elongate mandrel;
   - a rotating sleeve mounted about said mandrel;
   - an outer sleeve longitudinally slidingly mounted about said mandrel and rotating sleeve;
   - an inwardly directed pin carried on said outer sleeve;
   - said rotating sleeve having a grooved path thereabout for receiving said pin for movement of said pin about said path, said path having first and second stop locations which are separated from each other longitudinally and circumferentially wherein longitudinal movement of said mandrel causes said sleeve to move circumferentially relative to said mandrel and wherein one of said stop locations in a set location for preventing longitudinal movement of said mandrel;
   - packer means incorporating a resilient expandable element operatively mounted with said mandrel for expansion outwardly into contract with the string, said packer means selectedly retracting and expanding depending on the stop locations of said pin to selectively isolate the production zone below the packer means when the pin is in said set position; and
   - means joined to said mandrel for supporting an instrument package therebelow.

2. The apparatus of claim 1 incorporating laterally extending detents located at multiple points around said outer sleeve, said detents extending radially outwardly and angled upwardly from said outer sleeve and having ends which engage the wall of the tubing string to resist upward movement, and spring means which biases said detents against upward movement but which spring means permits movement to enable downward movement of said outer sleeve in the tubing string.

3. The apparatus of claim 2 incorporating a second set of laterally extending detents located at multiple points around said outer sleeve, said detents extending radially outwardly and angled downwardly from said outer sleeve and having ends which engage the wall of the tubing string to resist downward movement, and spring means which biases said detents against upward movements but which spring means permits movement to enable upward movement of said outer sleeve in the tubing string.

4. The apparatus of claim 3 wherein said detents include a transversely extending mounting pin, said pin supporting said detents for pivotal movement, and said detents further including a portion thereof which protrudes toward the interior of said outer sleeve, and including a tapered shoulder means on said mandrel selectively engaging said detents for moving them between extended and retracted positions.

5. The apparatus of claim 1 incorporating laterally extending detents located at multiple points around said outer sleeve, said detents extending radially outwardly and angled downwardly from said outer sleeve and having ends which engage the wall of the tubing string to resist downward movement, and spring means which biases said detents against upward movement but which spring means permits movement to enable upward movement of said outer sleeve in the tubing string.

6. The apparatus of claim 1 including a tapered cone and a set of collet means slidably positioned on the exterior surface of said tapered cone, said collet means and tapered cone are operatively connected to said mandrel and outer sleeve which causes relative radial movement of said collet finger means toward the tubing string on relative axial movement between said mandrel and said outer sleeve.

7. The apparatus of claim 6 wherein said collet finger means are appended to the lower end of an encircling collar like member and are defined by lengthwise slots extending partly but not fully to the end thereof, and said collet means include serrations on the outer face thereof to engage and grip the wall of the tubing string.

8. The apparatus of claim 1 including a hollow axial passage in said mandrel terminating at a lateral passage through the wall thereof;

upper and lower seal members carried by the interior of said outer sleeve sealingly engaged with the exterior surface of said mandrel, said seal members being spaced apart from one another and adapted to bracket said lateral passage; and passage means in said outer sleeve extending to the wall thereof and located beyond said upper and lower seal members and above said packer means, said passage means defining a selectively openable fluid path around said packer means.

9. An anti-kick, anti-fall running tool for use in a tubing string comprising:

an elongate mandrel;

a sleeve about said mandrel;

an inwardly directed pin carried on said sleeve; and anti-kick means for preventing untimely upward movement during running into said tubing string.

10. The apparatus of claim 9 wherein said anti-kick means includes laterally extending detents located at multiple points around said sleeve, said detents extending radially outwardly and angled upwardly from said sleeve and having ends which engage the wall of the tubing string to resist upward movement, and spring means which biases said detents against upward movement but which spring means permits movement to enable downward movement of said sleeve in the tubing string.

11. The apparatus of claim 10 incorporating a second set of laterally extending detents located at multiple points around said sleeve, said detents extending radially outwardly and angled downwardly from said sleeve and having ends which engage the wall of the tubing string to resist downward movement, and spring means which biases said detents against upward movements but which spring means permits movement to enable upward movement of said sleeve in the tubing string.

12. The apparatus of claim 11 wherein said detents include a transversely extending mounting pin, said pin supporting said detents for pivotal movement, and said detents further including a portion thereof which protrudes toward the interior of said sleeve, and including a tapered shoulder means on said mandrel selectively engaging said detents for moveing them between extended and retracted positions.

13. The apparatus of claim 9 incorporating laterally extending detents located at multiple points around said sleeve, said detents extending radially outwardly and angled downwardly from said sleeve and having ends which engage the wall of the tubing string to resist downward movement, and spring means which biases said detents against upward movement but which spring means permits movement to enable upward movement of said sleeve in the tubing string.

14. An apparatus for enabling isolation of a production zone of a well bore having a tubing string therein and for enabling desired tests to be run in the zone comprising:

an elongate mandrel;

packer means incorporating a resilient expandable element including a flaired skirt mounted with said mandrel for expansion outwardly into contact with the tubing string;

a collar and sleeve mounted about said mandrel above said packer means, said collar including depending flexible fingers thereon;

a second set of rigid fingers mounted with said collar about said mandrel and having a like amount of fingers on said collar fingers, one of each of said second set of fingers extending outwardly from beneath one of each of said collar fingers;

first taper means mounted above said packer means and adjacent and beneath said rigid fingers; and second taper means mounted beneath said packer means adjacent said skirt wherein upward movement of the mandrel causes each of said taper means to move upwardly to force said rigid fingers and said packer element outwardly to contact the tubing string which thereby prevents unwanted movement of the mandrel and isolates the zone below the element by enabling the element to seal between the mandrel and string.

15. The structure as set forth in claim 14 including a hollow axial passage in said mandrel terminating at a lateral passage through the wall thereof;

upper and lower seal members carried by the interior of said sleeve sealingly engaged with the exterior surface of said mandrel, said seal members being spaced apart from one another and adapted to bracket said lateral passage; and passage means in said sleeve extending to the wall thereof and located beyond said upper and lower seal members and above said packer means, said passage means defining a selectively openable fluid path around said packer means.

* * * * *